US006427857B1

(12) United States Patent
Adams et al.

(10) Patent No.: US 6,427,857 B1
(45) Date of Patent: Aug. 6, 2002

(54) EXPANDABLE DISPLAY APPARATUS AND METHODS

(75) Inventors: Duane D. Adams, Mount Upton, NY (US); James E. Gram, Orland Park, IL (US); Douglas Oosterman, Grand Rapids, MI (US); Michael Duffy, Chicago, IL (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/535,393

(22) Filed: Mar. 24, 2000

Related U.S. Application Data

(60) Provisional application No. 60/160,072, filed on Mar. 26, 1999.

(51) Int. Cl.[7] ..... A47F 5/00

(52) U.S. Cl. ..... 211/189; 211/162; 211/175

(58) Field of Search ..... 211/175, 189, 211/162, 187; 52/36.2, 36.4, 36.5; 108/108

(56) References Cited

U.S. PATENT DOCUMENTS

| | | | | | |
|---|---|---|---|---|---|
| 2,987,195 | A | | 6/1961 | Smith | 211/175 |
| 3,101,681 | A | * | 8/1963 | Streater | |
| 3,971,477 | A | | 7/1976 | Bruderly et al. | 211/189 |
| 4,093,078 | A | | 6/1978 | Radek | 211/189 |
| 4,326,637 | A | | 4/1982 | James | 211/175 |
| 4,488,652 | A | | 12/1984 | Hinton et al. | 211/183 |
| 4,611,866 | A | | 9/1986 | Everett | 312/257 |
| 4,655,352 | A | | 4/1987 | Noyes et al. | 211/175 |
| 4,657,149 | A | | 4/1987 | Masson | 211/194 |
| 4,657,317 | A | * | 4/1987 | Gemma | 211/162 X |
| 4,896,778 | A | | 1/1990 | Ferdinand et al. | 211/175 |
| 4,919,282 | A | * | 4/1990 | Duff et al. | 211/187 X |
| 5,341,944 | A | * | 8/1994 | Latino | 211/162 |
| RE35,047 | E | * | 10/1995 | Potter | 211/162 |
| 5,680,943 | A | | 10/1997 | Robley | 211/171 |
| 5,732,834 | A | * | 3/1998 | Wells | 211/162 |
| 5,857,578 | A | | 1/1999 | Fishman | 211/189 |
| 5,871,108 | A | * | 2/1999 | White | 108/108 X |
| 5,918,750 | A | * | 7/1999 | Jackson | 211/189 |
| 6,193,083 | B1 | * | 2/2001 | Wood | 211/189 X |

* cited by examiner

*Primary Examiner*—Robert W. Gibson, Jr.
(74) *Attorney, Agent, or Firm*—Lawrence P. Trapani

(57) ABSTRACT

An expandable display apparatus comprises a main display unit and first and second expandable display panels. The main unit is defined as having a centerline axis. The main unit includes a pair of side walls oriented substantially along and disposed on opposite sides of the centerline axis. One or both of the side walls may include a display panel. The main unit contains first and second end openings oriented substantially across the centerline axis and disposed in opposing spaced-apart relation. The end openings communicate with a storage space between the pair of side walls. The display panels are removably stored side-by-side in the storage space and are movable in opposite directions through the end openings. The panels are movable along respective paths between respective stored positions inside the storage space and respective extended positions outside the storage space. The display panels align with the centerline axis of the main unit when the panels are in the extended position.

23 Claims, 6 Drawing Sheets

EXPANDABLE DISPLAY APPARATUS AND METHODS

CROSS-REFERENCE TO RELATED APPLICATIONS

This application claims the benefit of U.S. Provisional Application No. 60/160,072, filed Mar. 26, 1999.

BACKGROUND OF THE INVENTION

1. Technical Field

The present invention relates generally to fixtures for displaying articles of merchandise in retail stores, and more particularly to merchandise displays that can be configured and reconfigured for different requirements of the selling seasons.

2. Background Art

The sale of merchandise in retail stores invariably requires the use of display fixtures, such as racks, display cases, peg-board displays, gondola-type displays, "island" displays, etc., hereinafter referred to as "displays." These displays are manufactured in a wide variety of configurations to accommodate a wide variety of merchandise.

The demand for some types of merchandise is cyclic or seasonal due to the nature of the merchandise. For example, "back-to-school" merchandise, such as school clothing and supplies, are in great demand in the months leading up to the start of the academic year. The Christmas selling season is another example of the cyclic demand for a wide variety of consumer goods. Retail stores are constantly adjusting their inventory to meet these expected seasonal demands.

With adjustments in inventory, there arises the need to reconfigure, knock-down or set-up, reduce or expand, re-organize, rotate, and update the displays in the store. Such efforts are time consuming, and require skilled labor, storage space, maintenance, inventory of tools, parts and material, and sometimes require the hiring of outside services. This problem is further exacerbated by the intricate and inflexible display apparatus typically found in retail stores today. Efforts to overcome this problem have be proposed in U.S. Pat. No. 4,093,078 (1978) to Radek and U.S. Pat. No. 3,971,477 (1976) to Bruderly et al. However, the systems proposed in these patents still require a significant amount of time, effort, skill, and parts to reconfigure the displays.

Other efforts have been directed to making the displays adjustable by way of expanding and contracting rods, rails, headers and columns. Examples of such efforts are disclosed in the following U.S. Pat. No. 4,896,778 (1990) to Ferdinand et al.; 4,655,352 (1987) to Noyes et al.; 4,611,866 (1986) to Everett; 4,488,652 (1984) to Hinton et al.; 4,326,637 (1982) to James; and 2,987,195 to Smith. The adjustability of these displays is somewhat limited in that they merely employ a standard unidirectional telescoping arrangement for a rail, rod, column, or header. The patent to Noyes et al. discloses a bi-directional telescoping header; however, its range of expansion is limited by the standard co-axial arrangement of the telescoping components. Furthermore, none of these patents propose such telescoping arrangements for display panels, a key component of large island or aisle displays. The arrangements proposed by the above-mentioned patents would severely limit the range of expansion/contraction in such large displays.

OBJECTS AND SUMMARY OF THE INVENTION

It is therefore an object of the present invention to provide display apparatus and methods that avoid the limits and problems associated with the prior art.

It is another object of the present invention to a provide display apparatus that has a flexible design.

It is a further object of the present invention to provide a display apparatus that is very easy to configure and reconfigure in the store, as the requirements of the selling seasons change.

It is yet another object of the present invention to provide display apparatus that are easy to move, position and use.

It is yet a further object of the present invention to provide display apparatus that can be used either as a permanent display or as a seasonal, portable display.

It is still another object of the present invention to provide display apparatus that are flexible enough to be easily combined with more seasonal or temporary displays.

It is still a further object of the present invention to provide a display apparatus that can be configured for many different display applications.

It is yet still another object of the present invention to provide display apparatus and methods that maximize the range of expansion and contraction of display components, thus increasing the range of applications for such apparatus and methods.

It is yet still a further object of the present invention to provide display apparatus that do not require nuts and bolts or other fasteners to configure and reconfigure the display.

It is yet still a further object of the present invention to provide display apparatus, the configurable parts of which (e.g., panels and headers) are connected to the display, so that such parts are not lost or misplaced.

It is yet still a further object of the present invention to provide display apparatus, the configurable parts of which (e.g., panels and headers) can be stored on or within the display, thus reducing the need for storage space.

It is yet still a further object of the present invention to provide a display apparatus that is substantially pre-assembled when shipped to the store.

These and other objects are attained in accordance with the present invention wherein there is provided an expandable display apparatus. The apparatus comprises a main display unit and first and second expandable display panels. The main unit is defined as having a centerline axis. The main unit includes a pair of side walls oriented substantially along and disposed on opposite sides of the centerline axis. One or both of the side walls may include a display panel or the side walls may, themselves, be display panels. The main unit contains first and second end openings oriented substantially across the centerline axis and disposed in opposing spaced-apart relation. The end openings communicate with a storage space located between the pair of side walls.

The display panels have distal and proximal ends and top and bottom ends. These panels are removably stored side-by-side in the storage space and are movable in opposite directions through the first and second end openings, respectively. The panels are movable along respective paths between respective stored positions substantially inside the storage space and respective extended positions substantially outside the storage space. The distal ends of the panels lead the panels out through the end openings when the panels are moved from the stored positions toward the extended positions. In the preferred embodiment, the display panels are aligned with the centerline axis of the main unit, when the panels are in the extended position.

In a typical embodiment, the display apparatus includes first and second end caps. The rear side of the first end cap faces the first end opening of the main display unit and adjoins the distal end of the first display panel. The rear side of the second end cap faces the second end opening of the main unit and adjoins the distal end of the second display panel. A first expansion header is coupled at one end to the main unit, above the first end opening, and is coupled at the other end to the first end cap, such that the first header is secured above the first display panel. A second expansion header is coupled at one end to the main unit, above the second end opening, and is coupled at the other end to the second end cap, such that the second header is secured above the second display panel.

The main display unit may also include a header. In such case, the first and second expansion headers are coupled to the main unit header. The main unit header contains a storage space configured and dimensioned to securely store the first and second expansion headers therein. The main display unit may be supported on casters, and the distal ends of the first and second display panels may also be supported by casters.

In a typical embodiment, the display of the present invention includes support mechanisms for the first and second display panels. These mechanisms support the display panels through their respective paths of movement, between stored and extended positions. Each of the support mechanisms includes top and bottom swing arms, each having a proximal end and a distal end. The proximal ends of the swing arms are pivotally coupled to top and bottom walls, respectively, of the main unit. The distal ends of the swing arms are both rotatably and slidably coupled to the top and bottom ends, respectively, of the display panel. Top and bottom slide bearings are rotatably mounted to the distal ends of the top and bottom swing arms, respectively. The display panel includes top and bottom slide channels at its top and bottom ends, respectively. The top and bottom slide bearings slidably engage the top and bottom slide channels, respectively.

An apparatus for shipping a display is also contemplated by the present invention. The shipping apparatus comprises a base, a ramp, a brace, and a securing mechanism. The base has a perimeter which includes an exit side. In one embodiment, the ramp is hinged to the base at the exit side. The ramp pivots at least between an inclined rest position and an upright shipping position. In another embodiment, the ramp may be a separate component. The brace is mounted along the perimeter of the base, for containing the display on the base. The brace includes a brace member removably secured along the exit side of the base. The securing mechanism, which may be a plurality of threaded bolts, is employed for securing the display to the base. In shipping, the display is contained on and secured to the base, and the ramp is in the upright position. In unpacking, the brace member and the securing mechanism are removed, and the ramp is lowered to the inclined position. This allows the display to be moved off the base, down the ramp, and to a desired location.

BRIEF DESCRIPTION OF THE DRAWING

Further objects of the present invention will become apparent from the following description of the preferred embodiment with reference to the accompanying drawing, in which.

DETAILED DESCRIPTION OF THE PREFERRED EMBODIMENT

Figure 1:
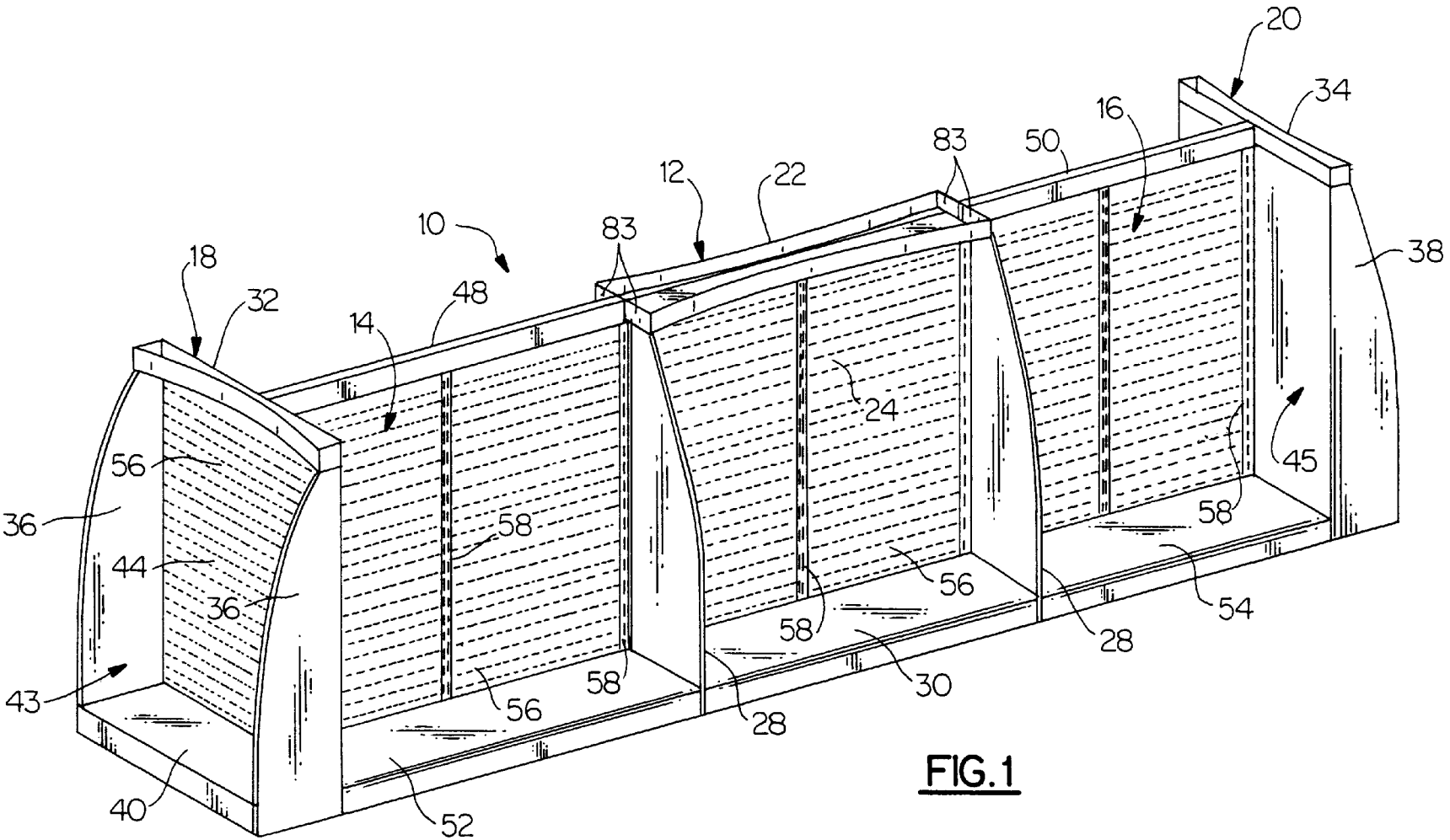
FIG. 1 is a perspective view of the display of the present invention, showing the display in a fully extended configuration.
Figure 11:
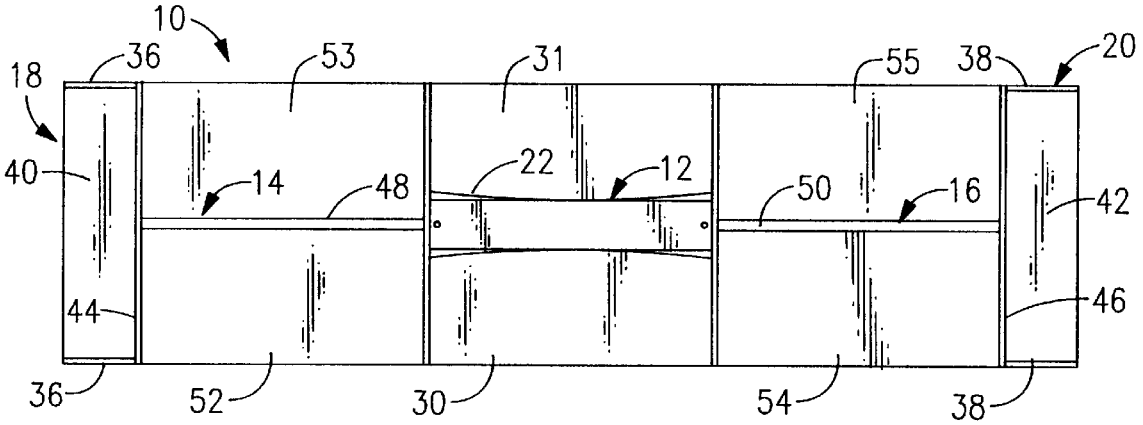
FIG. 11 is a diagrammatic top plan view of the display of the present invention, showing the display in a fully extended configuration.

Referring now to FIG. 1, there is shown an expandable display 10 constructed in accordance with the present invention. In FIG. 1, display 10 is shown in a fully expanded configuration. Display 10 includes a main display unit 12, expansion panels 14 and 16, and end cap display units ("end caps") 18 and 20. A main unit header 22 is removably mounted to the top portion of main display unit 12. Unit 12 includes front and rear display panels 24 and 26 (FIG. 7) which, in this embodiment, also function as structural side walls for unit 12. Main unit 12 also includes front and rear side skirts 28 and 29 (FIGS. 2 and 4) and front and rear kick plates 30 and 31 (FIG. 11).

End cap headers 32 and 34 are removably mounted to the top portion of end caps 18 and 20, respectively. End caps 18 and 20 also include side skirts 36 and 38, respectively, kick plates 40 and 42, respectively (FIG. 11), and display panels 44 and 46, respectively (FIG. 11). End caps 18 and 20 have a front display side 43 and a rear utility side 45 (FIG. 2).

Mounted over display panels 14 and 16 are expansion headers 48 and 50, respectively. In this embodiment, headers 48 and 50 are mounted to main header 22 and to end cap headers 32 and 34, respectively. In an alternative embodiment, headers 48 and 50 may be mounted directly to display panels 14 and 16, respectively, and to main header 22. Front and rear kick plates 52 and 53 are removably mounted near the bottom of display panel 14 (FIG. 11), and front and rear kick plates 54 and 55 are removably mounted near the bottom of display panel 16 (FIG. 11).

Display panels 14 and 16, 24 and 26, and 44 and 46, are constructed of perforated sheet metal 56 (FIG. 6) and metal stanchion tubes 58. Stanchion tubes 58 contain a series of rectangular holes 59 (FIG. 2) for receiving brackets to shelves, hang bars and other fixtures. Both sides of display panels 14, 16 are identical, and both sides are used for supporting shelves, hang bars and the like. The construction of the display panels are well known, and such panels are commercially available. It is desirable that panels 14, 16, 24, 26 be of identical construction to reduce the number of different parts in the assembly.

Figure 2:
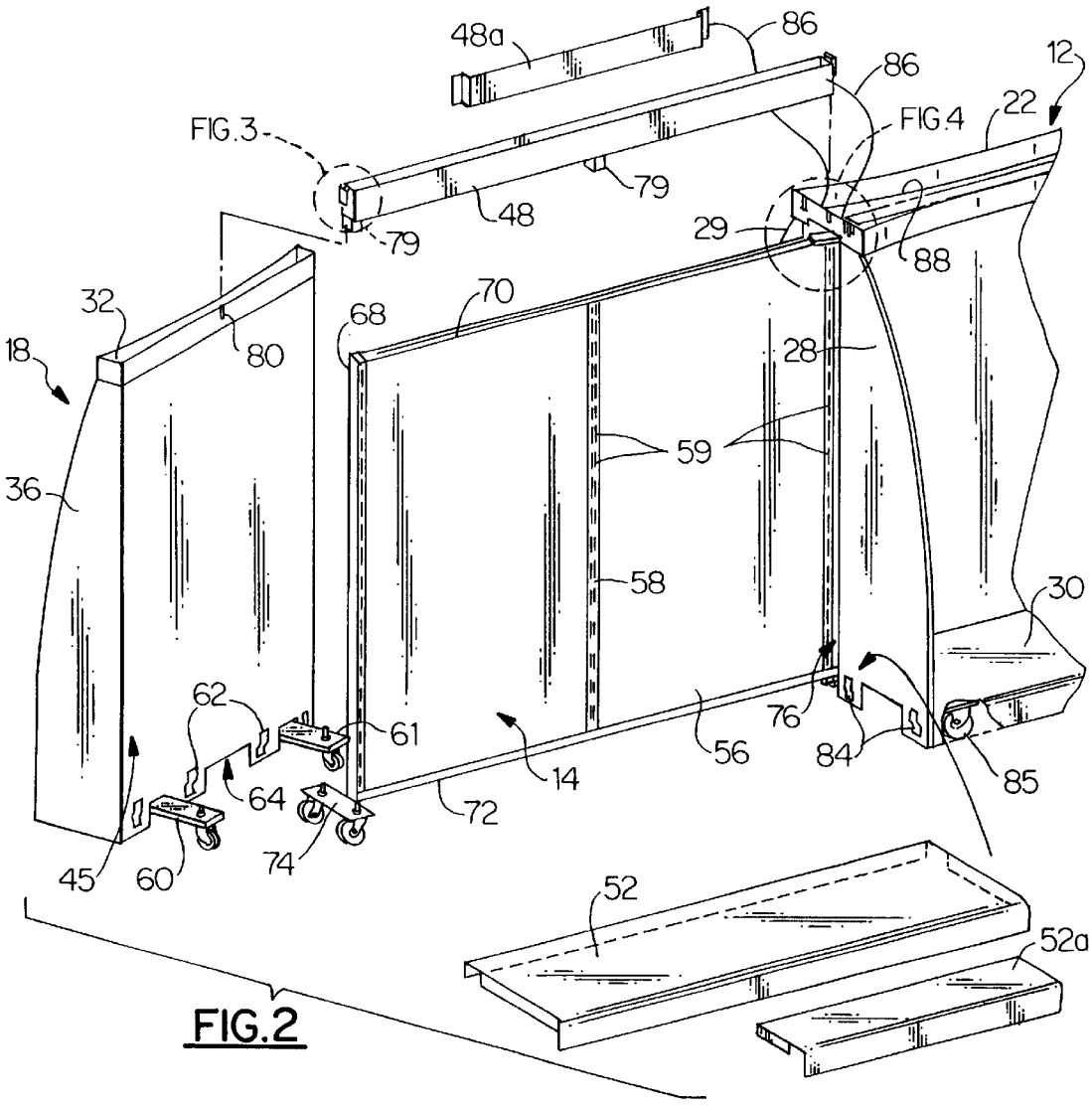
FIG. 2 is an enlarged perspective view of one side of the display of FIG. 1, showing several of its component parts.

Referring now to FIG. 2, several components of display 10 (and their assembly) will now be described. FIG. 2 shows the left side of display 10, which is sufficient for the understanding both sides of the display, both sides being essentially identical. End cap 18 (as well as end cap 20) is supported on casters sets 60, 61, which makes end cap 18 mobile and facilitates the configuration and reconfiguration of display 10. End cap 18 also includes four resilient clips 62, spot welded or otherwise fastened to side 45. Their function is to support and hold one end of kick plates 52 and 53. End cap 18 also contains a bottom recess 64, which is appropriately sized and shaped to clear a set of casters on display panel 14.

Display panel 14 (as well as display panel 16) has proximal and distal ends 66, 68 (FIG. 7) and top and bottom ends 70 and 72 (FIG. 2). A set of casters 74 are mounted to display panel 14 (as well as display panel 16) and extend out from distal end 68 (FIG. 2). When configuring display 10, end caps 18, 20 are positioned over casters 74 so that sides 45 of the end caps abut against ends 68 of the display panels. Casters 74 fit neatly into recesses 64 of the end caps. In an alternative embodiment, ends 68 may be physically fastened or coupled to the end caps, e.g., at sides 45.

Figure 3:
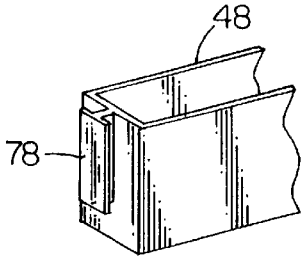
FIG. 3 is an enlarged fragmentary view of the circled area marked "FIG. 3 " in FIG. 2, showing one end of an expansion header.

With further reference to FIG. 2, display panel 14 is shown in a fully extended position. It is fully extended from a stored position inside main unit 12. FIG. 7 illustrates the stored position for panel 14. Main unit 12 contains an end opening 76 (FIG. 6) through which panel 14 passes when being pulled out to an extended position or when being pushed in to the stored position. In FIG. 2, display 10 is being set up in the fully extended configuration. Display panel 14 is pulled out to its fully extended position. End cap 18 is wheeled into position against distal end 68 of panel 14. End cap 18 is then connected to main unit 12 by way of expansion header 48. Header 48 is an elongated box-like piece with "T" tabs 78 formed or welded on each end (See FIG. 3). Tabs 78 slide into corresponding slots contained in end cap header 32 and main unit header 22. End cap header 32 contains a slot 80 and main unit header 22 contains a center slot 82 (See FIGS. 2, 4 and 4A), which receive tabs 78 of the expansion header.

The connection of end cap 18 (as well as end cap 20) to main unit 12 is completed by installing kick plates 52 and 53. As shown in FIG. 2, a pair of resilient clips 84 are spot welded or otherwise fastened near the bottom of side skirt 28 (and side skirt 29—not shown in FIG. 2). The opposing ends of kick plates 52 and 53 engage clips 62 on the end cap and clips 84 on the side skirts. Kick plates 52 and 53 are supported and held in place by clips 62 and 84. Attention is now directed to kick plate 30 in FIG. 2, where a portion has been cut away to reveal a caster 85. Caster 85 is one of a plurality of casters supporting main unit 12 in an upright position.

In an alternative embodiment, expansion headers 48 and 50 may be connected to their respective display panels 14 and 16. This arrangement may be instead of or in addition to a connection to the end caps. In such an embodiment, expansion header 48 may include stanchion tabs 79, which closely mate with the top openings of stanchion tubes 58, in display panel 14.

It is not necessary for display panels 14 and 16 to be moved to their fully extended positions. They may be extended, e.g., only half way. Such an incremental or intermediate position is shown in FIG. 4A. Display panel 14 is extended half way out of main unit 12. A correspondingly smaller expansion header **48*a* (FIGS. 2 and 4) is used instead of header 48. In this case, header 48*a* is an elongated flat piece of metal with two bends on each end. The bends produce an offset tab 78*a*. As shown in FIG. 4A, tabs 78*a* contain open slots adapted to slide into center slot 82 of header 22 and slot 80 of header 32. The reason for the offset of tabs 78*a* will be explained below. End cap 18 is positioned against panel 14 in the same manner as if panel 14 was fully extended. End cap 18 is connected to main unit 12 by header 48*a* and a shorter kick plate 52*a* (FIG. 2). Kick plate 52*a* is secured in place by at least one of clips 84 and at least one of clips 62. A matching kick plate (not shown) is placed on the other side of panel 14**.

Display panels 14 and 16 are, e.g., four feet long, from proximal end to distal end. In FIG. 4A, panel 14 is extended only two feet. As shown in FIGS. 2 and 4A, expansion headers 48 and **48*a*** have lengths set in accordance with the intended "extended" position of the display panel.

In the preferred embodiment, the length of main unit 12 corresponds to the length of display panels 14 and 16, so that unit 12 can properly house the panels when the panels are in the stored position. Main unit 12 may be slightly longer than the display panels, as best illustrated in FIG. 7.

As shown in FIG. 2, expansion headers 48 and **48*a* are tethered to main unit header 22 with wire cables 86 (See also FIG. 4A**). Tethering ensures that the headers are not misplaced or lost when not in use.

Figure 4:
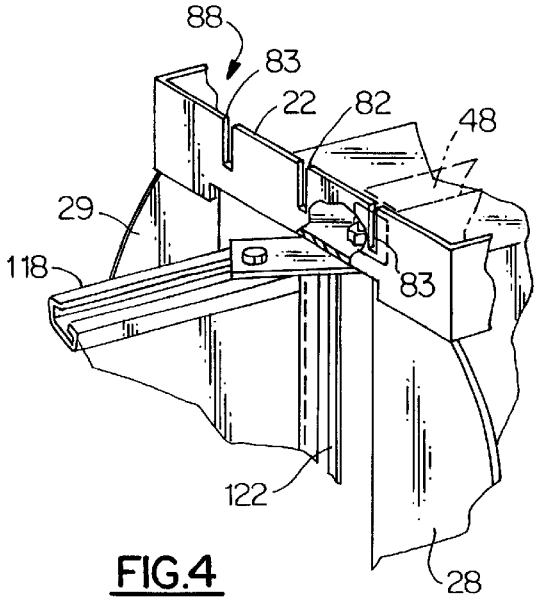
FIG. 4 is an enlarged fragmentary view of the circled area marked "FIG. 4 " in FIG. 2, showing, in part, a display panel, a support mechanism for the display panel, and a header for the main unit of the display.
Figure 4A:
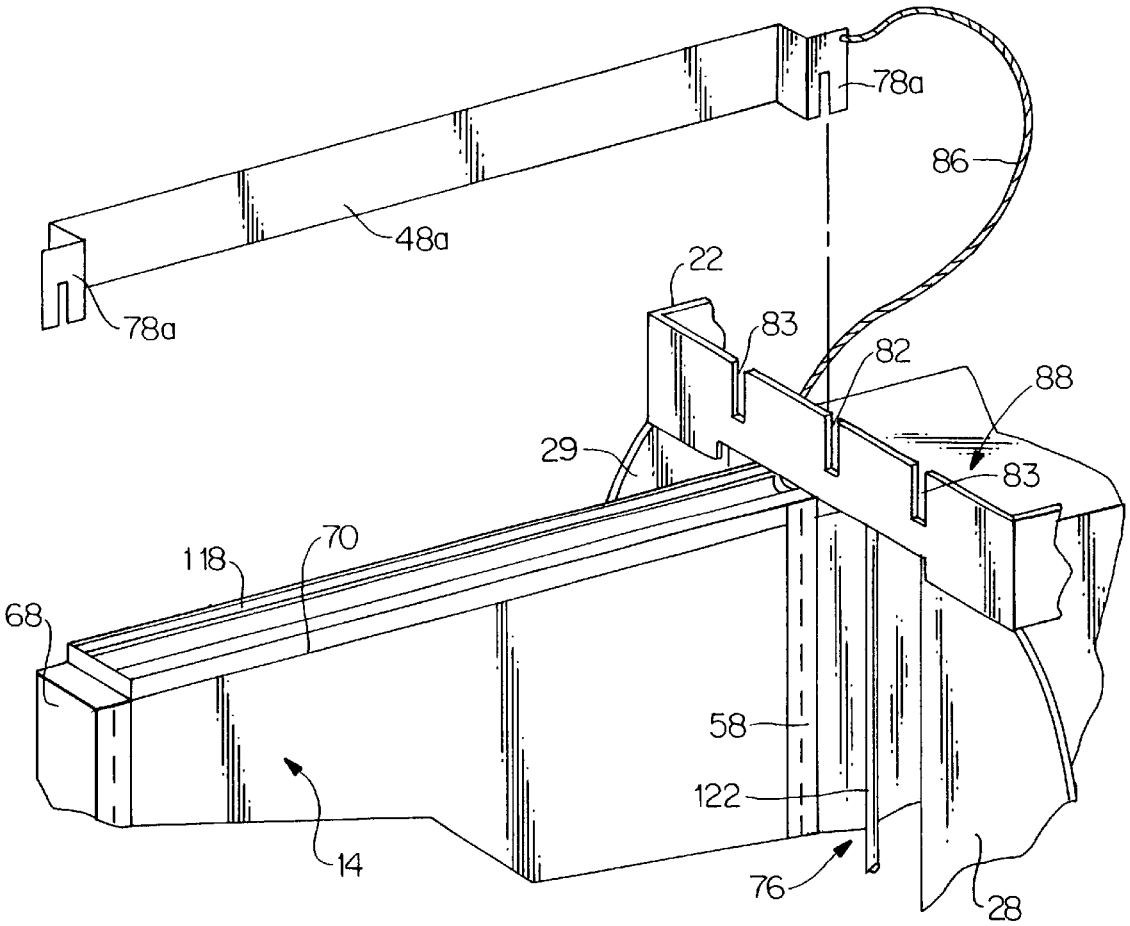
FIG. 4A is an enlarged fragmentary view of the main display unit (similar to FIG. 4), showing the display panel extended to an incremental (or intermediate) position between the stored and fully extended positions, and showing a short expansion header to accommodate the incremental position of the panel.

As shown in FIGS. 2, 4 and 4A, main unit header 22 contains a storage space 88 which runs the length of header 22. Both expansion headers 48 and 50 can be stored in header 22, and, alternatively, both headers **48*a* can be stored therein. As understood from FIG. 4, header 48 (shown in phantom lines) is stored in header 22 by sliding tabs 78 into storage slots 83. Slots 83 are located on each side of center slot 82 (FIGS. 4 and 4A) and at both ends of header 22 (FIG. 1). Tabs 78 of header 48 engage opposing slots 83 on header 22 (See also FIG. 10). As to header 48*a*, only one end thereof is slipped into slot 83**.

Figure 8:
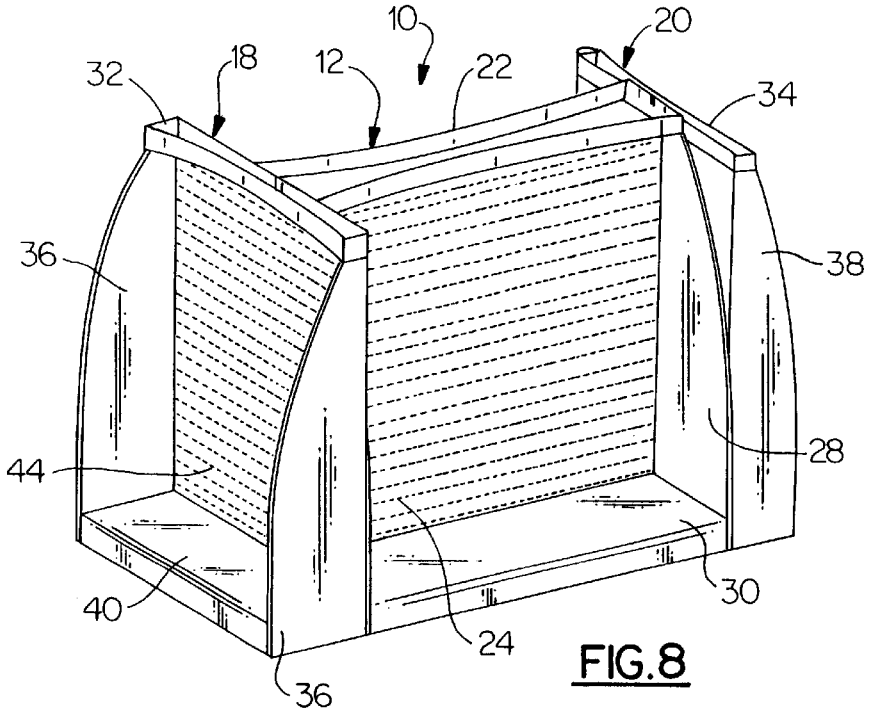
FIG. 8 is a perspective view of the display of the present invention, showing the display in a fully contracted configuration.
Figure 9:
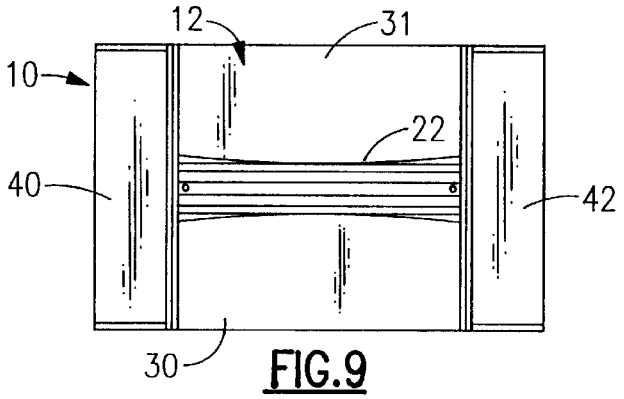
FIG. 9 is a diagrammatic top plan view of the display of the present invention, showing the display in a fully contracted configuration.

Header 48 may also function as a single connecting member for connecting both end caps to the main unit when display panels 14 and 16 are fully retracted inside the main unit (i.e., the configuration shown in FIGS. 8 and 9). In this case, header 48 is place inside storage space 88, and aligned with the opposing center slots 82. End caps 18 and 20 are abutted against the sides of main unit 12, such that end cap slots 80 are aligned with and adjacent to center slots 82. Tabs 78 of header 48 engage both slots 80 and 82 on each end, to lock end caps 18 and 20 to main unit 12. Alternatively, a pair of separate clips may be provided to lockingly engage slots 80, 82 on each end of main unit 12.

End caps 18, 20 may also be connected to the sides of main unit 12 (when display panels 14, 16 are fully retracted—FIGS. 8 and 9) by use of mating connectors or by fastners.

Figure 5:
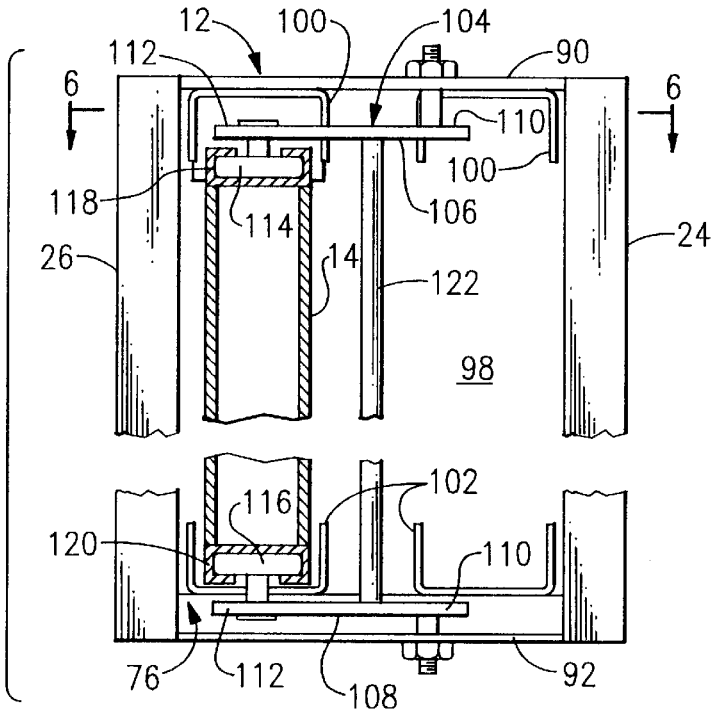
FIG. 5 is a side elevation view of the main display unit of the display of FIG. 1 (with certain exterior components removed for clarity), which includes a sectional view of a display panel extending from the main unit.
Figure 6:
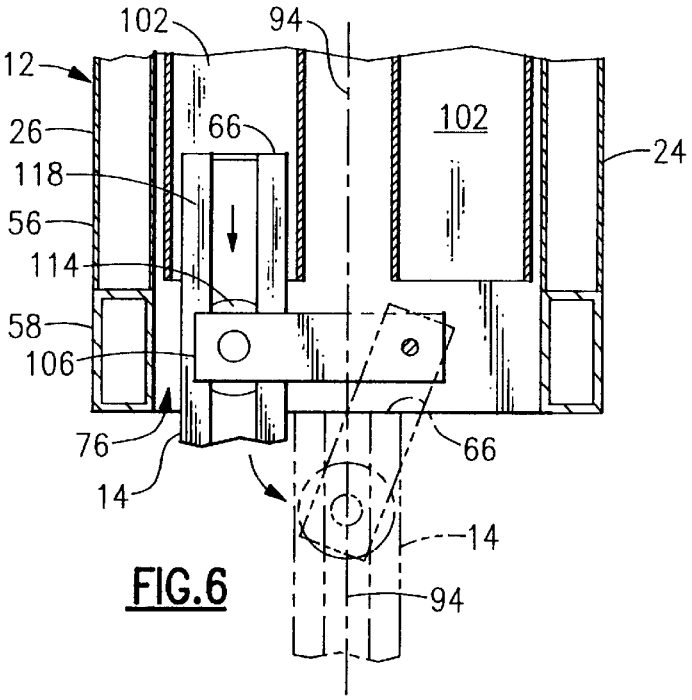
FIG. 6 is a partial sectional view of the main display unit taken along line 6—6 in FIG. 5, showing two positions of a display panel and the supporting mechanism therefor.
Figure 7:
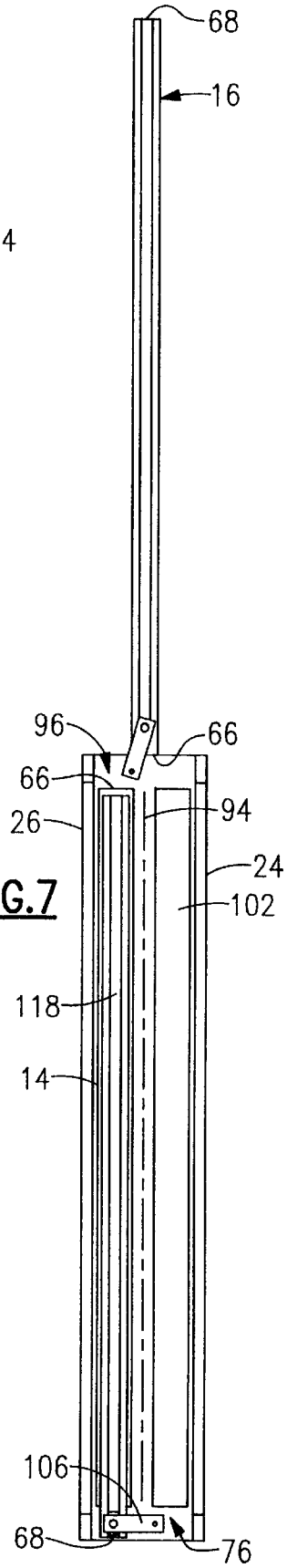
FIG. 7 is a diagrammatic top plan view of the main display unit, shown without a top wall to illustrate display panel positioning within and outside the main unit.

Referring now to FIGS. 5–7, the construction of main unit 12 will be described in greater detail. A side elevation view of main unit 12 is shown in FIG. 5, with casters and side skirts removed for clarity. In FIG. 5, display panel 14 is at least partially extended, thus it is shown in section. In this embodiment, main unit 12 includes a top wall 90 and a bottom wall 92. Welded or otherwise fastened to walls 90, 92 are display panels 24 and 26 panels 24 and 26 serve as side walls, providing structural support for main unit 12. In an alternative construction, separate side walls may be provided, to which panels 24, 26 are welded or otherwise fastened. Walls 90, 92 could be integrally joined or formed with a pair of separate side walls to form a box-like construction for main unit 12.

In the top-down sectional view of FIG. 6, main unit 12 is defined as having a centerline axis 94. Display panels 24 and 26 (or side walls) are oriented substantially along and disposed on opposite sides of centerline axis 94. As best shown in FIG. 7, main unit 12 contains end opening 76 and an end opening 96. End openings 76, 96 are oriented substantially across centerline axis 94 and are disposed in opposing spaced-apart relation. End openings 76, 96 communicate with an interior storage space 98 (FIG. 5) defined between display panels 24 and 25. Note that the rear sides (45) of end caps 18 and 20 face end openings 76 and 96, respectively, when joined with main unit 12.

The placement and movement of display panels 14 and 16 will now be described with reference to FIGS. 5–7. As understood from FIG. 7, display panels 14 and 16 are removably stored side-by-side in storage space 98. Panels 14 and 16 are movable in opposite directions through end openings 76 and 96, respectively. Panels 14 and 16 are movable along respective paths between respective stored positions (See panel 14 in FIG. 7) inside storage space 98 and respective extended positions (See panel 16 in FIG. 7) outside storage space 98. Distal ends 68 of panels 14 and 16 lead the panels out through end openings 76 and 96 when the panels are moved from their stored positions toward their extended positions (See FIG. 7).

As understood from FIGS. 6 and 7, display panels 14 and 16 are oriented substantially along and disposed on opposite sides of centerline axis 94, when the panels are in their stored positions. And, when the panels are in their extended positions, they are preferably aligned with centerline axis 94. Panel 14 is shown in the extended position, in phantom lines, in FIG. 6. Panel 16 is shown in the extended position in FIG. 7.

As shown in FIGS. 5–7, main unit 12 includes top and bottom slide tracks 100, 102 for each of the display panels. Bottom tracks 102 are positioned side-by-side in storage space 98, along and on opposite sides of centerline axis 94. Display panels 14 and 16 rest on tracks 102 when the panels are in their stored positions. The display panels slidably engage tracks 102 when the panels are moved from their stored positions toward their extended positions. Slide tracks 100, 102 guide panels 14 and 16 as the panels are moved.

A movable support for display panels 14 and 16 will now be described with reference to FIGS. 5 and 6. Display 10 includes a panel support mechanism 104 coupled to display panel 14. Support mechanism 104 supports panel 14 through the path of movement between the stored and the extended positions. An identical support mechanism is provided for display panel 16. Thus, the ensuing description will only concern the support for panel 14.

As shown in FIG. 5, support mechanism 104 includes top and bottom swing arms 106 and 108. Each swing arm has a proximal end 110 and a distal end 112 (FIG. 5). The proximal ends of arms 106 and 108 are pivotally coupled to top and bottom walls 90 and 92, respectively. This pivotal coupling may be implemented by the nut and bolt arrangement shown in FIG. 5. Top and bottom slide bearings 114 and 116 are rotatably mounted to the distal ends of arms 106 and 108, respectively. Display panel 14 (as well as display panel 16) contains top and bottom slide channels 118 and 120 at its top and bottom ends, respectively. Bearings 114 and 116 slidably engage channels 118 and 120, respectively. The rotatable coupling of bearings 114 and 116 to the distal ends of arms 106 and 108 allows the swing arms to rotate relative to the bearings, making possible the panel displacement shown in FIG. 6. Swing arms 106 and 108 are joined together by a tie rod 122. Tie rod 122 ensures that swing arms 106 and 108 move together, as one supporting unit.

From the above description, the operation of support mechanism 104 is understood. As panel 14 is pulled out of main unit 12, through end opening 76, toward the extended position, slide channel 118 slides past bearing 114. As panel 14 leaves tracks 100 and 102, swing arm 106 is free to rotate outward toward the position shown in phantom lines in FIG. 6. This rotational freedom allows panel 14 to be further extended and laterally displaced, as shown in phantom lines in FIG. 6. In the embodiment shown, proximal end 66 of panel 14 moves out to the edge of main unit 12 (as shown in phantom lines in FIG. 6). This is the fully extended position for panel 14. Note that panel 14 is centered on centerline axis 94 in this position. Panel 14 is offset from the centerline axis when it is in the incremental position shown in FIG. 4A. This offset is essentially as shown in FIG. 6 (solid lines). This offset is accommodated by expansion header 48*a* which has an offset configuration as described above.

FIG. 8 illustrates display 10 in a fully contracted configuration. In this configuration, end caps 18 and 20 abutted against the sides of main unit 12. End caps 18 and 20 are connected to main unit 12 as described above.

Figure 10:
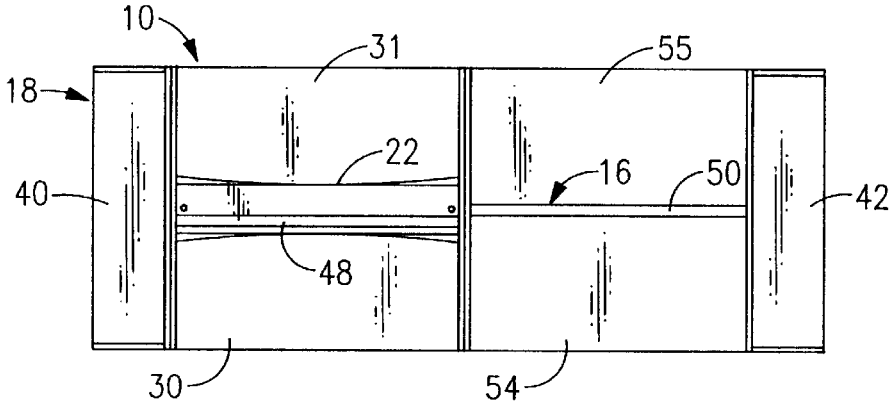
FIG. 10 is a diagrammatic top plan view of the display of the present invention, showing the display in a partially expanded configuration.

Referring now to FIGS. 9–11, there is shown display 10 in three different display configurations. In FIG. 9, display 10 is in a fully contracted configuration, with display panels 14, 16 stored inside main unit 12. In FIG. 10, display 10 is in a partially expanded configuration, with display panel 16 in an extended position and display panel 14 stored inside main unit 12. In FIG. 11, display 10 is in a fully extended configuration, with both display panels 14, 16 in extended positions.

Note, the configuration shown in FIG. 10 may be employed when it is desirable to grouped display 10 with another, separate display. In this example, end cap 18 would be removed from unit 12 to allow the other display to be juxtaposed with display 10. End cap 18 may then be positioned next to the other display.

A method of providing an expanded display is also contemplated by the present invention. As a preferred embodiment, the method comprises the steps of: (a) positioning main display unit 12 in a desired display location; (b) moving display panel 14 from its stored position to its extended position; (c) moving display panel 16 from its stored position to its extended position; (d) adjoining end cap 18 and distal end 68 of display panel 14; (e) adjoining end cap 20 and distal end 68 of display panel 16; (f) coupling expansion header 48 to header 22 of main unit 12 and to header 32 of end cap 18, such that header 48 is secured above display panel 14; and (g) coupling expansion header 50 to header 22 of main unit 12 and to header 34 of end cap 20, such that header 50 is secured above panel 16.

Figure 12:
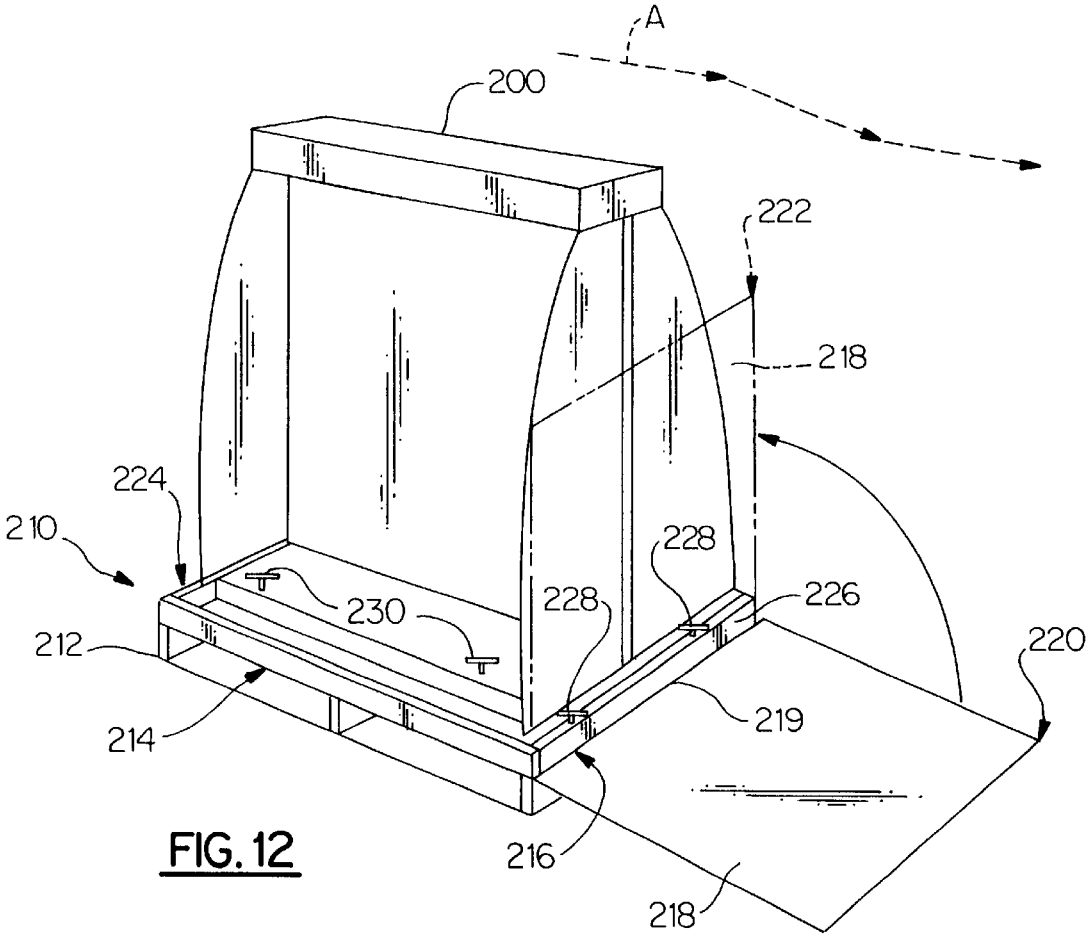
FIG. 12 is a diagrammatic perspective view of an apparatus for shipping a display, constructed in accordance with the present invention.

An apparatus for shipping a display is also contemplated by the present invention. As shown in FIG. 12, a display 200 is prepared to be shipped in or unpacked from a shipping apparatus 210 of the present invention. Apparatus 210 includes a base 212 on which display 200 is secured. Base 212 may be, e.g., a wooded pallet. Base 212 is defined as having a perimeter 214 which includes an exit side 216. A ramp 218 is hinged to base 212 at exit side 216. The hinged connection may be established via standard flat hardware-type hinges fastened to base 212, or by gluing an end portion of the ramp to base 212 and fashioning a seam 219 between the end portion and the remainder of the ramp. Ramp 218 pivots at least between an inclined rest position 220 and an upright shipping position 222 (shown in phantom lines). In an alternative embodiment, ramp 218 may be a separate piece. In such case, ramp 218 would be placed in inclined position 220 by simply leaning ramp 218 on the exit side of base 212, or by securing ramp 218 to the exit side, e.g., by inserting it into a slot or by hooking it on tabs.

Shipping apparatus 210 includes bracing 224, mounted entirely around perimeter 214. Bracing 224 contains display 200 on base 212. Bracing 224 includes a brace member 226 which is removably secured along exit side 216 via a pair of "T" shaped bolts (or "T" bolts) 228. A pair "T" bolts 230 are also employed to secure display 200 directly to base 212. Thus, display 200 is contained on and secured to base 212, and, in shipping, ramp 218 is secured in upright position 222. During unpacking, "T" bolts 228, 230 and brace member 226 are removed, and ramp 218 is lowered to inclined position 220. Then display 200 is moved off base 212, down ramp 218, and to a desired display location (the direction of such movement is represented by dashed arrows A).

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

What we claim is:

1. An expandable display apparatus, comprising:

a main display unit including a main display panel and a centerline axis, said main display unit containing an internal storage space and first and second end openings communicating with the internal storage space, the first and the second end openings being oriented substantially across the centerline axis and disposed in opposing spaced-apart relation, the main display panel having means for supporting brackets, hang bars and the like; and first and second display panels having distal and proximal ends and top and bottom ends, said first and said second display panels being removably stored side-by-side in the storage space and being movable in opposite directions through the first and the second end openings, respectively, said panels being movable along respective paths between respective stored positions substantially inside the storage space and respective extended positions substantially outside the storage space, whereby the distal ends of said panels lead said panels out through the end openings when said panels move from the stored positions toward the extended positions.

2. The expandable display apparatus of claim 1, wherein said main display unit further includes another main display panel, the main display panels being oriented substantially along and disposed in opposing relationship on each side of the centerline axis.

3. An expandable display apparatus, comprising:

a main display unit having a centerline axis, said main unit including a pair of side walls oriented substantially along and disposed on opposite sides of the centerline axis, said main unit containing first and second end openings oriented substantially across the centerline axis and disposed in opposing spaced-apart relation, the first and second end openings communicating with a storage space between the pair of side walls;

first and second display panels having distal and proximal ends and top and bottom ends, said first and said second display panels being removably stored side-by-side in the storage space and being movable in opposite directions through the first and the second end openings, respectively, said panels being movable along respective paths between respective stored positions substantially inside the storage space and respective extended positions substantially outside the storage space;

a first end cap having a front display side and a rear side, the rear side facing the first end opening of said main display unit and adjoining the distal end of said first display panel;

a second end cap having a front display side and a rear side, the rear side facing the second end opening of said main display unit and adjoining the distal end of said second display panel;

a first expansion header coupled at one end to said main display unit above the first end opening and coupled at the other end to said first end cap, such that said first header is secured above said first display panel; and a second expansion header coupled at one end to said main display unit above the second end opening and coupled at the other end to said second end cap, such that said second header is secured above said second display panel.

4. An expandable display apparatus, comprising:

a main display unit having a centerline axis, said main unit including a pair of side walls oriented substantially along and disposed on opposite sides of the centerline axis, said main unit containing first and second end openings oriented substantially across the centerline axis and disposed in opposing spaced-apart relation, the first and second end openings communicating with a storage space between the pair of side walls; and first and second display panels having distal and proximal ends and top and bottom ends, said first and said second display panels being removably stored side-by-side in the storage space and being movable in opposite directions through the first and the second end openings, respectively, said panels being movable along respective paths between respective stored positions substantially inside the storage space and respective extended positions substantially outside the storage space, the distal end of each of said panels being supported by at least one wheel, whereby the distal ends of said panels lead said panels out through the end openings when said panels move from the stored positions toward the extended positions.

5. An expandable display apparatus, comprising:

a main display unit containing an interior storage compartment and an opening communicating with the storage compartment, said main unit having top and bottom walls disposed between a pair of side walls;

a display panel having top and bottom ends, said display panel being removably stored in the storage compartment and being movable through the opening of the main unit, along a path between a stored position substantially inside the storage compartment and an extended position substantially outside the compartment; and panel support means for supporting said display panel through the path of movement between the stored and extended positions, said support means including top and bottom swing arms each having a proximal end and a distal end, the proximal ends of the top and bottom swing arms being pivotally coupled to the top and bottom walls, respectively, of said main unit, and the distal ends of the top and bottom swing arms being both rotatably and slidably coupled to the top and bottom ends, respectively, of said display panel.

6. The expandable display apparatus of claim 1, wherein each of said first and said second display panels include means for supporting a shelf thereon.

7. The expandable display apparatus of claim 1, wherein said first and said second display panels slidably engage the main unit as said panels move from their respective stored positions toward their respective extended positions.

8. The expandable display apparatus of claim 3, wherein said first expansion header has a length set in accordance with an intended position of said first display panel extended from its stored position, and wherein said second expansion header has a length set in accordance with an intended position of said second display panel extended from its stored position.

9. The expandable display apparatus of claim 3, wherein said first and said second expansion headers are tethered to said main unit.

10. The expandable display apparatus of claim 3, wherein said main display unit includes a header bridging the pair of side walls of said main unit, and wherein said first and said second expansion headers are coupled to the header of said main unit.

11. The expandable display apparatus of claim 10, wherein the main unit header contains a storage space configured and dimensioned to securely store said first and said expansion headers therein.

12. The expandable display apparatus of claim 11, further comprising:

first support means, coupled to said first display panel, for supporting said first panel through the path of movement between the stored position and the extended position; and second support means, coupled to said second display panel, for supporting said second panel through the path of movement between the stored position and the extended position.

13. The expandable display apparatus of claim 12, wherein said first and said second display panels are in substantial alignment with the centerline axis of said main unit, when said panels are in their respective extended positions.

14. The expandable display apparatus of claim 13, wherein said first and second display panels are oriented substantially along and disposed on opposite sides of the centerline axis of said main unit, when said panels are in their respective stored positions.

15. The expandable display apparatus of claim 12, wherein said first panel support means includes top and bottom swing arms each having a proximal end and a distal end, and wherein said main display unit has top and bottom walls disposed between the pair of side walls of said unit, the proximal ends of the top and bottom swing arms being pivotally coupled to the top and bottom walls, respectively, and the distal ends of the top and bottom swing arms being both rotatably and slidably coupled to the top and bottom ends, respectively, of said first display panel.

16. The expandable display apparatus of claim 15, further comprising:

top and bottom slide bearings, rotatably mounted to the distal ends of the top and bottom swing arms, respectively, and wherein said first display panel has top and bottom slide channels at its top and bottom ends, respectively, the top and bottom slide bearings slidably engaging the top and bottom slide channels, respectively, of said first display panel.

17. The expandable display apparatus of claim 15, wherein said second panel support means includes top and bottom swing arms each having a proximal end and a distal end, the proximal ends of the top and bottom swing arms being pivotally coupled to the top and bottom walls, respectively, and the distal ends of the top and bottom swing arms being both rotatably and slidably coupled to the top and bottom ends, respectively, of said second display panel.

18. The display apparatus of claim 17, further comprising:

top and bottom slide bearings rotatably mounted to the distal ends of the top and bottom swing arms, respectively, and wherein said second display panel has top and bottom slide channels at its top and bottom ends, respectively, the top and bottom slide bearings slidably engaging the top and bottom slide channels, respectively, of said second display panel.

19. The expandable display apparatus of claim 1, wherein said main unit further includes first and second slide tracks positioned side-by-side in the storage space of said unit, and wherein said first and said second display panels rest on the first and the second slide tracks, respectively, when said panels are in their respective stored positions, and wherein said first and said second display panels slidably engage the first and the second slide tracks, respectively, when said panels move from their respective stored positions toward their respective extended positions.

20. A method of providing an expanded display, employing the display apparatus of claim 1, said method comprising the steps of:

(a) positioning said main display unit in a desired location;

(b) moving said first display panel from its stored position to its extended position; and (c) moving said second display panel from its stored position to its extended position.

21. A method of providing an expanded display, employing the display apparatus of claim 1, said method comprising the steps of:

(a) positioning said main display unit in a desired location;

(b) moving said first display panel from its stored position to its extended position;

(c) moving said second display panel from its stored position to its extended position;

(d) adjoining a first end cap and the distal end of said first display panel;

(e) adjoining a second end cap and the distal end of said second display panel;

(f) coupling a first expansion header to said main unit and to said first end cap, such that said first header is secured above said first display panel; and (g) coupling a second expansion header to said main unit and to said second end cap, such that said second header is secured above said second display panel.

22. The display apparatus of claim 5, further comprising:

top and bottom slide bearings rotatably mounted to the distal ends of the top and bottom swing arms, respectively, and wherein said display panel includes top and bottom slide channels at its top and bottom ends, respectively, the top and bottom slide bearings slidably engaging the top and bottom slide channels, respectively, of said display panel.

23. The expandable display apparatus of claim 5, wherein said main unit further includes a slide track positioned in the storage compartment of said unit, and wherein said display panel rests on the slide track when said panel is in the stored position and slidably engages the slide track when said panel move from the stored position toward the extended position.

* * * * *